United States Patent [19]

Jones

[11] 3,984,990

[45] Oct. 12, 1976

[54] SUPPORT MEANS FOR A WELL RISER OR THE LIKE

[75] Inventor: Howard W. Jones, Long Beach, Calif.

[73] Assignee: Regan Offshore International, Inc., Torrance, Calif.

[22] Filed: June 9, 1975

[21] Appl. No.: 585,375

[52] U.S. Cl. ..... 61/99; 166/.5; 175/7

[51] Int. Cl.[2] ..... B63B 35/00; E21B 15/02

[58] Field of Search ..... 61/46, 46.5; 175/7; 166/.5; 114/.5 D; 9/8 P; 285/DIG. 1, 302

[56] References Cited

UNITED STATES PATENTS

| | | | |
|---|---|---|---|
| 3,319,981 | 5/1967 | Burgess | 285/302 |
| 3,481,294 | 12/1969 | Vincent | 114/.5 D |
| R26,290 | 10/1967 | Rand | 175/7 |
| R27,261 | 12/1971 | Brommell et al. | 175/7 |

*Primary Examiner*—Casmir A. Nunberg
*Assistant Examiner*—Alex Grosz
*Attorney, Agent, or Firm*—Poms, Smith, Lande & Glenny

[57] ABSTRACT

Improvements in support means for well risers wherein the risers extend through a rotary table on a floating vessel down to a subsea well. A spider supports the upper end of the riser and hydraulically operated gimbal means support the spider with respect to the table to maintain a constant load on the riser. Inertia absorbing means is associated with the gimbal means so that, when sections or buoyancy chambers or the like are added to the riser and it is lowered down to the well, or vessel movement takes place, any off-center load that is acting on the spider that is not equally distributed, the inertia absorbing means absorbs such load and equally distributes it so as to maintain a constant load on the riser.

18 Claims, 4 Drawing Figures

Fig. 1.
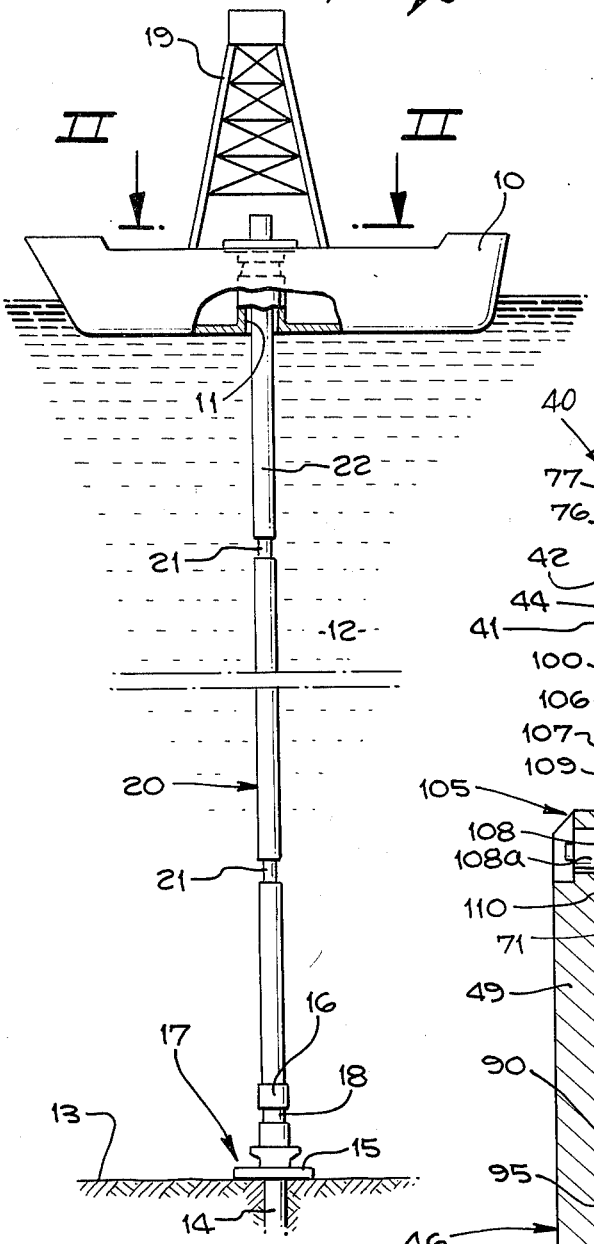
Fig. 3.
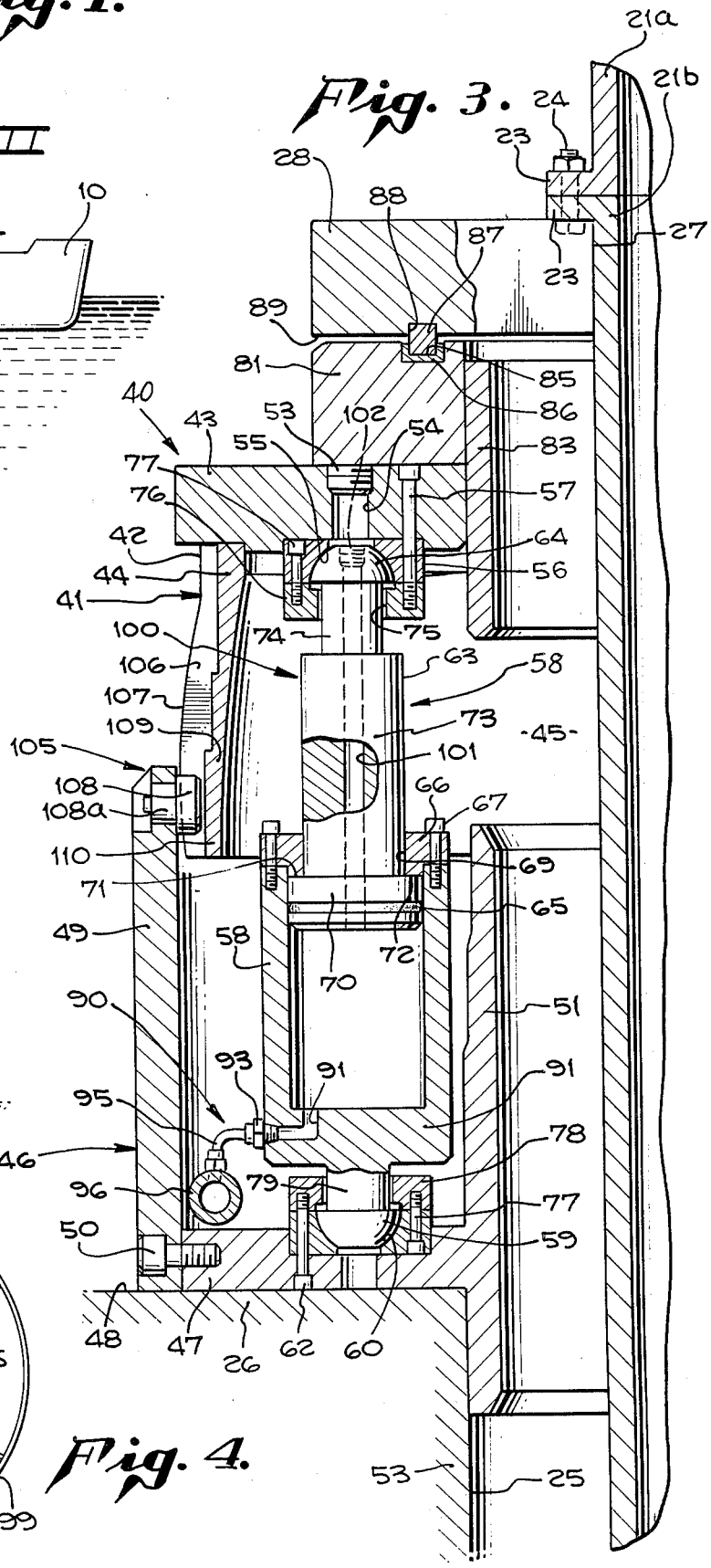
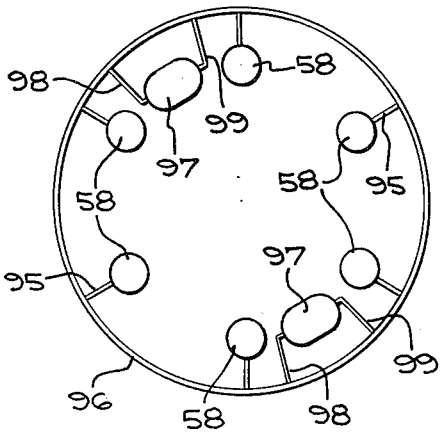
Fig. 4.

SUPPORT MEANS FOR A WELL RISER OR THE LIKE

BACKGROUND OF THE INVENTION

1. Field of the Invention

The invention relates to subsea well installations; and, more particularly, to improvements in support means for well risers.

2. Description of the Prior Art

In the oil well industry, certain assemblies have been used for drilling oil wells in subsea locations. Generally, such assemblies include a riser carrying a string of drill pipe used to carry out the drilling operations. This riser extends from a vessel floating on the surface down to the subsea well. At the vessel, the upper portion of the riser extends through a throughbore in a rotary table which will subsequently be used to rotate the drill pipe during drilling operations. Such a riser is comprised of a plurality of sections and is assembled by supporting the uppermost section of the riser on the vessel, then subsequently adding sections and lowering the riser until the desired overall length is reached.

In such operations, a spider may be used which is disposed above the rotary table on the vessel and is opened to encircle the riser, then closed to support the riser sections by means of a flange on each riser section which flange is supported on the spider.

The riser sections are then added to the uppermost section of the riser supported on the spider by means of derricks or the like on the vessel which lifts a section over the assembled riser sections, then lowers it down onto the top of the riser where the flange of the added-on riser section may be bolted or otherwise secured to the flange of the topmost section of the assembled riser.

It is preferable during such operations that a constant load be maintained on the riser, regardless of motion of the vessel due to movement thereof. Further, if the added-on riser section comes down hard or drops down on top of the topmost riser section, a tremendous load is placed on the assembled riser which itself is of considerable weight. If this load is slightly off, it will drop one side of the spider. This may cause considerable damage to both the riser, and/or the rotary table or vessel itself.

There is thus a need for means maintaining a constant balanced load on a riser extending from a vessel to a subsea wellhead installation, and particularly a need for compensating for loads placed on the supporting equipment on the vessel as sections or buoyancy chambers or the like are added onto the riser.

SUMMARY OF THE INVENTION

It is an object of this invention to provide improvements in support means for well risers extending from a floating vessel to a subsea well wherein a constant load is maintained on the support means as the riser is lowered down to the subsea well.

It is another object of this invention to provide improvements in support means for well risers wherein a constant load is maintained on such risers regardless of vessel movement taking place.

It is still another object of this invention to provide a means for absorbing the inertia of loads placed on the uppermost section of the riser supported on the floating vessel as sections or buoyancy chambers are added to the riser.

These and other objects are preferably accomplished by providing a spider on the vessel which supports the upper end of the riser above a rotary table on the vessel and hydraulically operated gimbal means which support the spider with respect to the table to maintain a constant load on the riser. Inertia absorbing means is associated with the gimbal means so that, when sections or buoyancy chambers or the like are added to the riser and it is lowered down to the well, or vessel movement takes place, any off-center impact load that is placed on the spider that is not equally distributed, the inertia absorbing means absorbs such load and equally distributes it so as to maintain a constant load on the riser. The spider, gimbal means and inertia absorbing means may comprise one integral unit or the gimbal means and inertia absorbing means may comprise one integral unit adapted to be aligned with the spider.

BRIEF DESCRIPTION OF THE DRAWINGS

FIG. 1 is an elevational view of apparatus in accordance with the present invention showing a vessel floating on the surface having a riser extending down to a subsea well;

FIG. 3 is a view taken along lines III—III of FIG. 2; and

FIG. 4 is a diagrammatic view of a common manifold for carrying out the techniques of my invention.

DESCRIPTION OF THE PREFERRED EMBODIMENT

Figure 2:
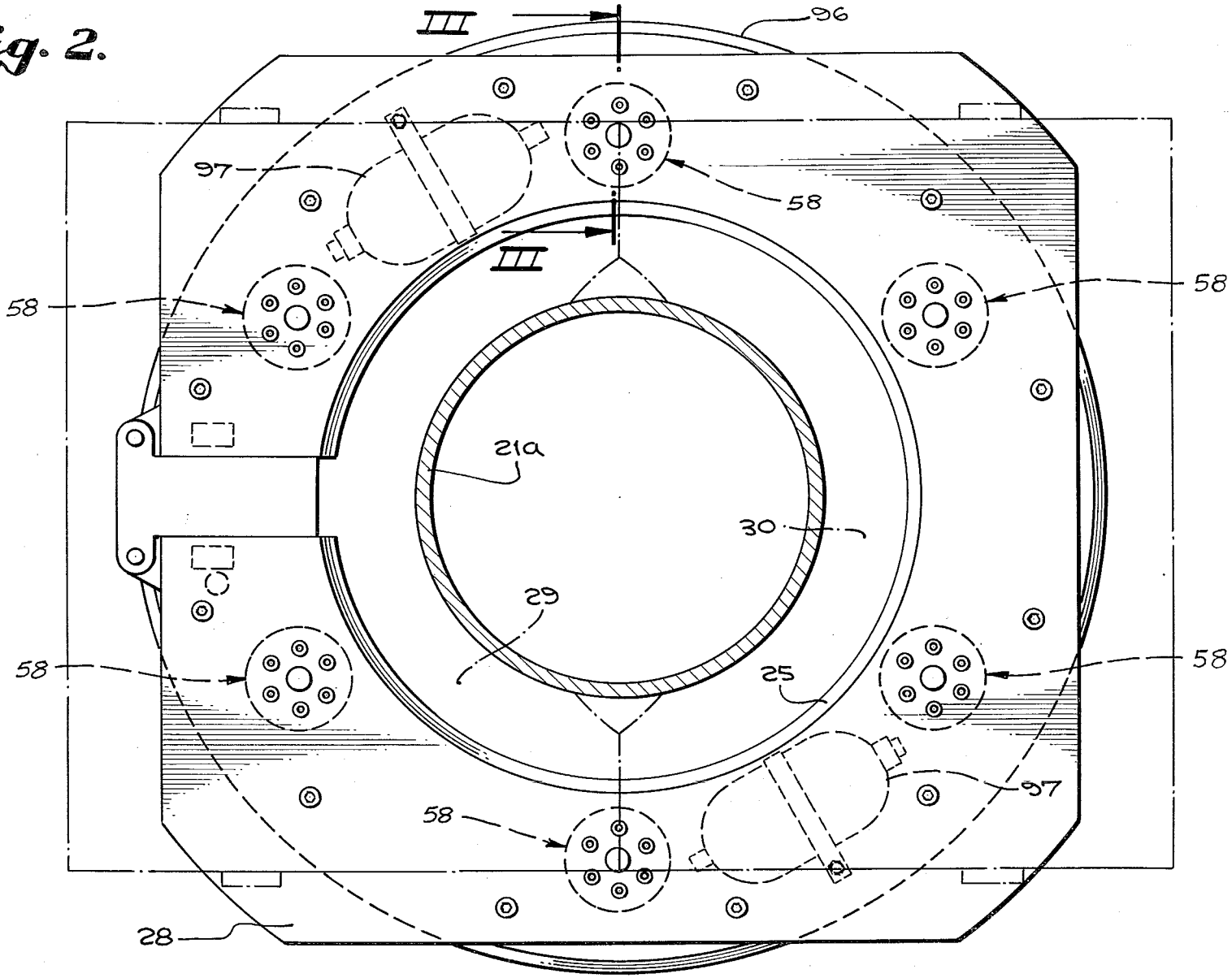
FIG. 2 is a view taken along lines II—II of FIG. 1.

A subsea well riser or conductor conduit 20 extends from a floating vessel or platform 10 through the body of water 12 to a wellhead 17. The vessel is suitably anchored on the surface of the water. The subsea well riser conduit is run from the vessel or platform of slot 11, which is below the derrick 19, to the wellhead indicated generally at 17 which is mounted on the well template 15 above the conductor pipe 14 in the formation 13. Conventional blowout preventer apparatus 16 and riser coupling apparatus 18 may be additionally provided at the wellhead.

The subsea well riser conduit 20 is formed of a plurality of conductor conduit sections 21. These conduit sections may be generally approximately 40 to 50 feet long. It is contemplated that the riser conduit of the instant invention could be used in a drilling operation conducted at a depth of 6,000 feet below the water surface.

Each conduit section 21 may have associated therewith buoyancy chambers 22 as disclosed in a U.S. Pat. No. 3,858,401 to Watkins for providing flotation means for the riser. As shown in FIGS. 2 and 3, the uppermost riser conduit section 21*a* includes a peripheral flange 23 which enables section 21*a* to be secured to a succeeding riser conduit section 21*b* by locking engagement, via suitable fastening means such as nuts and bolts 24. These sections 21*a*, 21*b* form the riser 21 and may include chambers 22. That is, flanges 23 may either form a part of the riser sections 21*a*, 21*b* or form a part of chambers 22. The inventive features, to be discussed hereinbelow, thus include either the assembly of riser sections alone or with the addition of chambers 22, the techniques to be disclosed being applicable to both.

Generally, the riser 21 extends through a throughbore 25 in a rotary table 26 fixedly mounted on vessel 10. As will further be discussed, the riser 21 also extends through a throughbore 27, generally coaxially aligned with throughbore 25, in a conventional spider 28 above table 26 on vessel 10. Spider 28, as shown in FIG. 3, includes a plurality of gates 29, 30 which open to encircle riser section 21*a*, then are closed to clamp riser section 21*a* therebetween. Such spiders are well known in the subsea drilling art and thus further discussion is deemed unnecessary.

However, referring once again to FIG. 2, in certain conventional riser section connecting operations, the spider 28 is merely mounted on the upper surface of rotary table 26. As particularly contemplated in the present invention, gimbal means 40 are provided for maintaining the riser 21 suspended from spider 28 in a generally vertical position with respect to spider 28. Also as particularly contemplated in the present invention, inertia absorbing means, as described hereinafter, are provided in association with gimbal means 40 for absorbing a load placed on gimbal means 40 so as to maintain a constant load thereon.

Thus, in the exemplary embodiment of the invention, such gimbal means 40 includes housing means indicated generally at 41 and comprised of an upper housing section 42 including a top plate 43 having a downwardly extending skirt portion 44 forming an open area 45 within upper housing section 42 between skirt portion 44 and the riser 21. Housing means 41 further includes a lower housing section 46 having a bottom wall 47 adapted to be supported on the upper surface 48 of rotary table 26 and an upwardly extending side wall 49 secured to plate 47 by bolts 50 or the like.

A second upwardly extending side wall 51 is integral with bottom wall 47 and spaced from said wall 49. Side wall 51 extends past or downwardly from bottom wall 47 to thereby form a lower skirt portion which, together with bottom wall 47, conforms to the top surface 48 and side wall 53 of table 26 so as to align the throughbore 25 in table 26 with the gimbal means 40. Gimbal means 40 further includes a top plate 43 having a removable plug 53 closing off a passageway 54 opening into a socket 55 secured to top plate 43 by bolts 57.

Upper housing section 42 is supported on lower housing section 46 by a plurality of piston cylinder means 58 as seen in FIG. 2. Each such cylinder means is constructed as seen in FIG. 3. Referring to FIG. 3, each cylinder means 58 includes a cylinder 58' having ball means such as a hemispherically shaped ball 59 rotatably received in a socket 60 fixedly secured, via bolts 62, to bottom wall 47 of lower housing section 46. The spacing of ball 59 in socket 60 is such so as to allow a limited amount of rotation, e.g., about 3° to 4°. This may be accomplished by providing spacing, such as about 3/32nd inches, between ball 59 and a member 76 fixed to socket 55 as will be discussed. A piston 63 is slidably mounted within cylinder 58' and terminates at its upper end in a ball means such as a hemispherically shaped ball 64 rotatably mounted within socket 55. The spacing of ball 64 in socket 55 is similar to that of ball 59 to provide a limited amount of rotation. One or more piston sealing members 65 may be provided on piston 63 within cylinder 58'. Cylinder 58' is closed off at the upper open end by a top plate 66 secured, via bolts 67, to the main body portion of cylinder 58'. Piston 63 extends through an opening 69 in top plate 66 and includes an enlarged bottom portion 70 forming a shoulder 71 which abuts against the underside 72 of top plate 66 to prevent its withdrawal therefrom. Piston 63 also includes an intermediate body portion 73 between bottom portion 70 and a reduced diameter upper portion 74 having ball 64 thereon. Portion 74 extends through an opening 75 in a member 76 secured to ring 56 by bolts 77 or the like. A like member 78 secures an extension portion 79 of cylinder 58 having ball 59 thereon to socket 60 by similar bolts 77.

A spacer 81 may be disposed between the gimbal means 40 and spider 28. The upper surface 85 of spacer 81 includes a fixed track 86 receiving therein a key 87 or the like fixed in a notch 88 in the undersurface 89 of spider 28. This key 87 keeps the gate of the spider 28 aligned during sliding movements.

As shown in FIGS. 2 and 3, gimbal means 40 includes a plurality of cylinder means 58 and the associated apparatus disposed about housing means 41, such as the six shown in dotted lines below spider 28 in FIG. 2. The cylinder means 58 extend about housing means 41 in generally circular array, as shown in FIG. 4. As subsequently described, hydraulic fluid is supplied to the cylinder means 58 to support the upper housing section 42 under loading due to the landing of riser sections on spider 28.

Gimbal means 40, as particularly contemplated in the present invention, may also include horizontal rotation limiting means 105 for preventing the upper housing section 42 from rotating too far with respect to the lower housing section 46. In the exemplary embodiment, such means 105 may include a slot 106 formed in skirt portion 44 with the outer surface 107 of skirt portion 44 being curved as shown in FIG. 3. A rotatable stop member 108 is rotatably mounted in a sleeve 108*a* fixedly secured to the upper portion of side wall 49. The walls of slot 106 act as a stop for limiting horizontal rotation of section 42. That is, stop member 108 abuts against the walls of slot 106 when the upper housing section 42 rotates in a horizontal plane. The curved surface 107 permits skirt portion 44 to slide over the inner upper edge of side wall 49 when upper section 42 is moved with respect to the lower section 46.

As particularly contemplated in the present invention, inertia absorbing means 90 may be provided for absorbing inertial forces acting on the gimbal means 40. In the exemplary embodiment, such absorbing means 90 includes piston cylinder means 58 including the aforementioned pistons 63 and their slidable mounting in cylinders 58'. In addition, as shown in FIG. 3, the piston cylinder means includes a fluid passageway 91 extending through each cylinder 58' and coupled to a fluid outlet 93. A fluid conduit 95 interconnects each fluid outlet 93 with a common manifold 96 (see also FIG. 4). Means 90 also includes in the exemplary embodiment of the invention, one or more fluid accumulator means, such as accumulators 97, which are coupled, via fluid line 98,99 to manifold 96. Any suitable accumulators may be used. For example, accumulators are well known in the fluid handling art which are used to equalize hydraulic line pressures. In one known type, the accumulator includes a cylinder or the like into which the hydraulic fluid, such as oil which may be initially present in manifold 96 and cylinders 58 and the related fluid lines, is pumped against a weighted piston or the like, which adds its weight to the oil in the system to maintain a balanced line pressure without damaging lines and equipment.

Inertia absorbing means 90, in the exemplary embodiment, further includes air bleed means, indicated generally at 100, for bleeding off air from cylinder means 58. Thus, means 100 includes a passageway 101 extending axially through each piston 63 opening at one end into the interior of the cylinder 58'. The other end opens to the exterior of piston 63 but is normally capped by a removable plug 102. Thus, when it is desired to bleed off air from within cylinders 58', plugs 102 may be removed and air bled off from the interior of cylinders 58.

In operation, housing means 41 is located as shown in FIG. 3 on rotary table 26. Spacer 81 is disposed between housing means 41 and the spider 28, the key 87 on spider 28 engaging track 86 on spacer 81.

As shown in FIG. 3, riser 21 extends through the throughbores in spider 28, housing means 41 and the rotary table 26. The uppermost riser section 21*a* is supported on the spider 28 by means of flange 23. In this position, the ball and socket arrangement of gimbal means 40 serves to maintain a constant load on riser 21. In addition, cylinder means 58, manifold 96, accumulators 97 and the fluid lines and conduits associated therewith are initially charged with an incompressible fluid, such as oil. Any air in cylinders 56 may be bled off by unplugging plugs 102 of means 100 prior to setting up the spider 28 and housing means 41.

When it is desired to add an additional riser section or buoyancy chambers to the uppermost riser section 21*a*, it is brought, as by suitable equipment associated with derrick 19, into generally vertical alignment with riser 21 and then lowered down on the uppermost section. When it comes down, a tremendous load is placed on spider 28, gimbal means 40 and table 26. In addition, if the added-on section or chamber is off-center, the weight is distributed onto one side of the upper housing section 42.

This forces the pistons 63 down within cylinders 58' thus forcing the incompressible fluid into accumulators 97. The accumulators 97 are adapted to maintain a balanced fluid pressure equally distributed to all the cylinders 58'. The ball-and-socket arrangement of gimbal means 40 permits a slight tilting of the upper section 42 of housing means 41 and the horizontal rotation thereof is limited by limiting means 105. As soon as the fluid pressures in cylinder means 58 are equalized, the upper section 42 returns to its initial position thus maintaining a constant load on riser 21. Also, if excessive movement of the vessel takes place due to roll and pitch thereof, the gimbal means 40 and the inertia absorbing means 90 associated therewith automatically compensates for such movement to maintain a constant load on the riser.

The curved portion 107 permits limited movement along the inner wall of side wall 49 while stop member 108 prevents excessive horizontal rotational movement of the upper housing section 42 with respect to the lower housing section 46.

Although housing means 41 has been disclosed which is separate from the spider 28, obviously spider 28 may form an integral part of the housing means 41.

It can be seen from the foregoing that I have described a method and apparatus for supporting a well riser run from a floating vessel to a subsea well and absorbing any load placed on the riser when sections or buoyancy chambers or the like are added thereto or movement of the vessel on which the apparatus is installed takes place due to roll and pitch of the vessel.

I claim:

1. In support means for a subsea well riser run in sections from a floating vessel to a subsea well and including a riser flange for supporting the upper end of the riser at said vessel, the improvement which comprises:

gimbal means disposed between said riser flange and said vessel for maintaining said riser suspended from said vessel in a generally vertical position during vessel movement, said gimbal means including an upper section in supporting relation with said riser flange and a lower section in supported relation to said vessel; and hydraulically operated means associated with said gimbal means for hydraulically supporting said upper section on said lower section of said gimbal means.

2. In support means for a subsea well riser run from a floating vessel to a subsea well and including a spider supporting the upper end of the riser at a rotatable table on said vessel, the improvement which comprises:

gimbal means disposed between said spider and said table adapted to maintain said riser suspended from said spider in a generally vertical position with respect to said spider, wherein said gimbal means comprises: a housing having an upper section supporting said spider and a lower section supported on said table, and a plurality of ball and socket means interconnecting said upper and lower sections at spaced locations about said spider and said table to thereby make one of said sections movable with respect to the other; and hydraulically operated means associated with said gimbal means for supporting said upper section on said lower section, said hydraulically operating means includes hydraulic cylinder means interconnecting each of said ball and socket means.

3. The improvement in support means of claim 2 wherein inertia absorbing means is associated with both said gimbal means and said hydraulic cylinder means for absorbing an impact placed on said gimbal means so as to maintain a constant load on the riser.

4. The improvement in support means of claim 3 wherein said inertia absorbing means includes incompressible fluid supply means operatively connected to all of said cylinder means for supplying fluid therebetween.

5. The improvement in support means of claim 4 wherein said fluid supply means includes a manifold in fluid communication with all of said cylinder means, and fluid accumulation means associated with said manifold for selectively taking in fluid from some of said cylinder means when a load is placed thereon greater than the load on the other of said cylinder means and flowing said taken-in fluid to other of said cylinder means to thereby balance the load on all of said cylinder means.

6. The improvement in support means of claim 5 wherein each of said cylinder means includes a piston slidably disposed in a piston chamber, said ball and socket means for being disposed at spaced locations about said housing means.

7. The improvement in support means of claim 6 wherein said ball and socket means includes a ball carried at the upper end of each of said pistons rotatably mounted in a socket secured to said upper section and a ball carried by the lower end of each of said chambers rotatably mounted in a socket secured to said lower section.

8. The improvement in support means of claim 7 including horizontal rotation limiting means associated with both the upper and lower sections of said housing for limiting the horizontal rotation of said ball and socket means.

9. The improvement in support means of claim 8 wherein said limiting means includes a stop member rotatably mounted on said lower section, a slot having abutment means thereon in the other of said sections, said stop member adapted to abut against said abutment means when said ball and socket means rotates horizontally.

10. The improvement in support means of claim 7 wherein air bleeding off means is associated with each of said piston cylinder means for selectively bleeding off air in each of said chambers.

11. In support means for a subsea well riser run from a floating vessel to a subsea well and including a spider supporting the upper end of the riser at a rotatable table on said vessel, the improvement which comprises:

gimbal means disposed between said spider and said table adapted to maintain said riser suspended from said spider in a generally vertical position with respect to said spider;

hydraulically operated means associated with said gimbal means for supporting said gimbal means, wherein:

inertia absorbing means is associated with said gimbal means and said hydraulically operated means for absorbing an impact placed on said gimbal means so as to maintain a constant load on said riser.

12. In support means for a subsea well riser run from a floating vessel to a subsea well and including a spider having a throughbore with said riser extending through said throughbore, said riser having an uppermost section with a flange thereon supported on the upper surface of said spider, and a rotatable table between said spider and the deck of said vessel, said table having a throughbore coaxially aligned with the throughbore of said spider with said riser extending through the throughbore in said table, the improvement which comprises:

a housing having relatively movable upper and lower sections disposed between said table and said spider, said riser extending through an opening in said housing and said spider supported on said upper section and said lower section supported on said table;

a plurality of spaced sockets fixedly secured to the underside of said upper surface;

a plurality of spaced sockets fixedly secured to the upper surface of said lower surface;

a piston cylinder having a ball as its lower end rotatably mounted in each of said sockets on the lower surfaces;

a piston slidably mounted in said cylinder terminating at its upper end in a ball rotatably mounted in a vertically aligned socket on said upper surface; and fluid flow means operatively connected to each of said cylinders for flowing incompressible fluid between each of said cylinders.

13. The improvement in support means of claim 12 wherein:

said fluid flow means includes a manifold interconnecting all of said cylinders, and at least one incompressible fluid accumulating means in said manifold for selectively accumulating an incompressible fluid from some of said cylinders and flowing said accumulated fluid to other of said cylinders when a load is placed on some of said cylinders of a load substantially greater than the other of said cylinder.

14. The improvement in support means of claim 13 including horizontal rotation movement limiting means associated with said housing for limiting the horizontal rotation of said pistons and piston cylinders with respect to said table and said spider.

15. The improvement in support means of claim 14 including a throughbore extending through said piston opening at one end into the exterior of said cylinder and at the other end to the exterior thereof, and a removable cap sealing off the end of said piston openings to the exterior of said cylinder for selectively bleeding off air from said cylinder.

16. In a method for supporting a subsea well riser run in sections from a floating vessel to a subsea well and absorbing load placed on said riser sections when vessel motion takes place or sections or the like are added at said vessel thereto wherein the uppermost section of said riser is supported by an associated flange by means on said vessel, the improvement which comprises the step of:

hydraulically supporting said means on said vessel at a plurality of spaced locations permitting limited horizontal and vertical movement of said means and thus said riser with respect to said vessel.

17. The improvement in method of claim 16 further including the step of absorbing any load placed at one of said spaced locations greater than a load placed at the other of said spaced locations and equally distributing said loads to each of said spaced locations to thereby balance said spider equally at each of said spaced locations and thus maintain a constant load on said riser.

18. In support means for a subsea well riser run in sections from a floating vessel to a subsea well and including a riser flange for supporting the upper end of the riser at said vessel, the improvement which comprises:

gimbal means disposed between said riser flange and said vessel for maintaining said riser suspended from said vessel in a generally vertical position during vessel movement;

hydraulically operated means associated with said gimbal means for hydraulically supporting portions of said gimbal means interposed between said riser flange and vessel; and inertia absorbing means associated with said gimbal means and said hydraulically operated means for absorbing impact loading placed on said gimbal means.

* * * * *